US005883463A

United States Patent [19]

Kikuchi et al.

[11] Patent Number: 5,883,463

[45] Date of Patent: Mar. 16, 1999

[54] IN-LINE ELECTRON GUN FOR COLOR CATHODE RAY TUBE WITH CUT AWAY STRUCTURE ON FIELD CORRECTING ELECTRODES

[75] Inventors: Norifumi Kikuchi, Kanagawa; Yasunobu Amano, Tokyo; Naruhiko Endo, Fukushima; Yoichi Ohshige; Masahiko Mizuki, both of Kanagawa, all of Japan

[73] Assignee: Sony Corporation, Japan

[21] Appl. No.: 885,190

[22] Filed: Jun. 30, 1997

[30] Foreign Application Priority Data

Jul. 5, 1996 [JP] Japan ..... 8-176314
Mar. 12, 1997 [JP] Japan ..... 9-058007

[51] Int. Cl.[6] ..... H01J 29/56

[52] U.S. Cl. ..... 313/414; 313/412

[58] Field of Search ..... 313/412, 414, 313/409, 421, 426

[56] References Cited

U.S. PATENT DOCUMENTS

| | | | |
|---|---|---|---|
| 4,812,706 | 3/1989 | Baudry et al. . | |
| 4,940,917 | 7/1990 | Still | 313/412 |
| 5,146,133 | 9/1992 | Shirai et al. | 313/412 |
| 5,182,492 | 1/1993 | Chen . | |
| 5,466,983 | 11/1995 | Shirai et al. | 313/414 |
| 5,488,265 | 1/1996 | Chen . | |
| 5,517,078 | 5/1996 | Sugawara et al. | 313/412 |
| 5,606,216 | 2/1997 | Uchida et al. | 313/412 |

FOREIGN PATENT DOCUMENTS

| | | |
|---|---|---|
| 0366245A2 | 5/1990 | European Pat. Off. . |
| 0452789A2 | 10/1991 | European Pat. Off. . |
| 2154789 | 9/1985 | United Kingdom . |
| WO91/02373 | 2/1991 | WIPO . |

*Primary Examiner*—Ashok Patel
*Assistant Examiner*—Matthew J. Gerike
*Attorney, Agent, or Firm*—Ronald P. Kananen; Rader, Fishman & Grauer

[57] ABSTRACT

An in-line electron gun for a color cathode ray tube having a main lens comprised of an in-line focusing electrode and accelerating electrode, with which it is possible to easily improve an assembly precision of field-correcting electrode plates provided at the focusing electrode and accelerating electrode and having three through apertures through which the R, G, and B electron beams pass and with which it is possible to easily perform an adjustment of aberration of the main lens. The two side through apertures among the three through apertures formed in the field-correcting electrode plate provided at the focusing electrode and accelerating electrode are formed basically as circular apertures with arc shaped cut-away portions continuous with the outside of the circular apertures and concentric with the circular apertures.

17 Claims, 5 Drawing Sheets

IN-LINE ELECTRON GUN FOR COLOR CATHODE RAY TUBE WITH CUT AWAY STRUCTURE ON FIELD CORRECTING ELECTRODES

BACKGROUND OF THE INVENTION

1. Field of the Invention

The present invention relates to an in-line electron gun of a color cathode ray tube, more particularly relates to an improvement in the electrode structure in a main lens electric field generating portion of an in-line electron gun of a color cathode ray tube.

2. Description of the Related Art

In recent years, in order to improve the resolution at a peripheral portion of a screen of a cathode ray tube, wide use has been made of cathode ray tubes using the common electric field system for the main lens of the in-line electron gun. In such an in-line electron gun, enlargement of the diameter of the main lens is achieved by forming a focusing electrode constituting the main lens and an accelerating electrode adjoining this by a cylindrical metal member having an elliptical cross-section having an opening through which three electron beams can pass.

In the in-line electron gun described above, since the shape of the opening of the focusing electrode and the accelerating electrode adjoining this is elliptical, the electric field in the main lens is asymmetrically distorted, aberration such as spherical aberration, astigmatism, or frame aberration occurs in the main lens and exerts an adverse influence upon the focusing characteristics etc. of the electron gun.

As a method for reducing the effect of the degree of the aberration, for example, a method of providing a field-correcting electrode plate comprised of a metal plate for correcting the electric field of the main lens along an opening direction of an internal portion of each of the focusing electrode and the accelerating electrode adjoining this has been known. This field-correcting electrode plate has three through apertures through which the electric beam may pass arranged in-line in the long axis direction of the elliptically shaped metal plate. Correction and adjustment of the aberration in the main lens is possible by adjustment of the shape of the through apertures, for example, not making the shape of the through apertures circular, but a special shape such as an ellipse, for example, suitably changing the diameter in the lateral direction and the diameter in the vertical direction.

However, in order to improve the performances of the in-line electron gun, it is necessary to raise the assembly precision at the time of assembly of the main lens. When positioning the field-correcting electrode plate with respect to the path of the electron beam, when the through apertures on both sides are circular in shape, high precision positioning is possible by inserting circular inner core guides into the through apertures, but when the above field-correcting electrode plate is used, since the through apertures do not have a circular shape, inner core guides having circular cross-sections for insertion into the through apertures cannot be used and therefore it was difficult to control the precision of positioning, particularly the precision of positioning in the rotation direction of the metal plate.

A method for solving the above problem has been proposed in for example Japanese Examined Patent Publication (Kokoku) No. 6-75378. In this method, by forming the center through aperture among the three through apertures of the field-correcting electrode plate as an elliptical aperture, forming the through apertures on the two sides as circular apertures, setting an aspect ratio of the elliptically shaped center through aperture of the field-correcting electrode plate within a predetermined range, and inserting circular inner core guides into the through apertures on the two sides at the time of assembly of the electron gun, high precision positioning can be carried out and, at the same time, distortion of the electric field of the main lens can be corrected. According to Japanese Examined Patent Publication (Kokoku) No. 6-75378, since the through apertures on the two sides of the field-correcting electrode plate are formed as circular apertures, it is easy to raise the assembly precision of the in-line electron gun, but since adjustment of the astigmatism is not possible, a corrective metal plate etc. for adjusting the astigmatism newly becomes necessary, therefore there was the continued disadvantage that the structure of the main lens became complex and also the assembly process became complex.

SUMMARY OF THE INVENTION

An object of the present invention is to provide an in-line electron gun for a color cathode ray tube having a field-correcting electrode plate having three through apertures through which electron beams can pass arranged in-line along a predetermined axial direction in the main lens with which the assembly precision can be easily improved and further the adjustment of aberration can be easily carried out.

According to the present invention, there is provided an in-line electron gun for a color cathode ray tube, comprising a field-correcting electrode plate having three through apertures through which electron beams may pass arranged in-line along a predetermined axial direction and forming a main lens, each of two side through apertures among the three through apertures being formed by a circular aperture and at least one predetermined shaped cut-away portion which is formed at the outside of the circular aperture and continues to the circular aperture.

Preferably, the cut-away portion is formed to an arc shape having the same center as that of the circular aperture.

Preferably, the center through aperture among the three through apertures formed in the field-correcting electrode plate is an elliptical aperture having a short axis on a predetermined axis.

Preferably, there are a plurality of field-correcting electrode plates.

Preferably, the ratio R2/R1 of a radius R1 of the circular aperture and a radius R2 of the arc of the cut-away portion is 1.0 to 1.3.

Preferably, the cut-away portions are formed close to the center through aperture among the three through apertures and crossing a predetermined axis.

Alternatively, the cut-away portions are formed away from the center through aperture among the three through apertures and crossing a predetermined axis.

Alternatively, the cut-away portions formed in the through apertures are formed at symmetrical positions with respect to a predetermined axis.

Alternatively, two cut-away portions are formed so the two cut-away portions straddle the paths of electron beams passing through the through apertures.

In the in-line electron gun for a color cathode ray tube according to the present invention, if cutaway portions are formed at symmetrical positions with respect to the long axis of the field-correcting electrode plate at the two side through apertures among the three through apertures formed in the plate, the electron beams passing through the two side through apertures will be straddled by the cut-away portions in the vertical direction. By suitably adjusting the shape of the cut-away portions, the astigmatism can therefore be adjusted. Further, since the two side through apertures are basically circular in shape, it is possible to perform positioning by inserting circular inner core guides in the through apertures, so a high precision of assembly is possible.

BRIEF DESCRIPTION OF THE DRAWINGS

These and other objects and features of the present invention will become more apparent from the following description of the preferred embodiments given with reference to the appended drawings, wherein:

FIGS. 5A and 5B are views of examples of other shapes of the field-correcting electrode plate in the in-line electron gun for a color cathode ray tube according to the present invention, in which FIG. 5A shows a case where out-away portions are formed close to the center through aperture and crossing the long axis of the field-correcting electrode plate; and FIG. 5B shows a case where the cut-away portions are formed away from the center through aperture and crossing the long axis of the field-correcting electrode plate.

DESCRIPTION OF THE PREFERRED EMBODIMENTS

Figure 1:
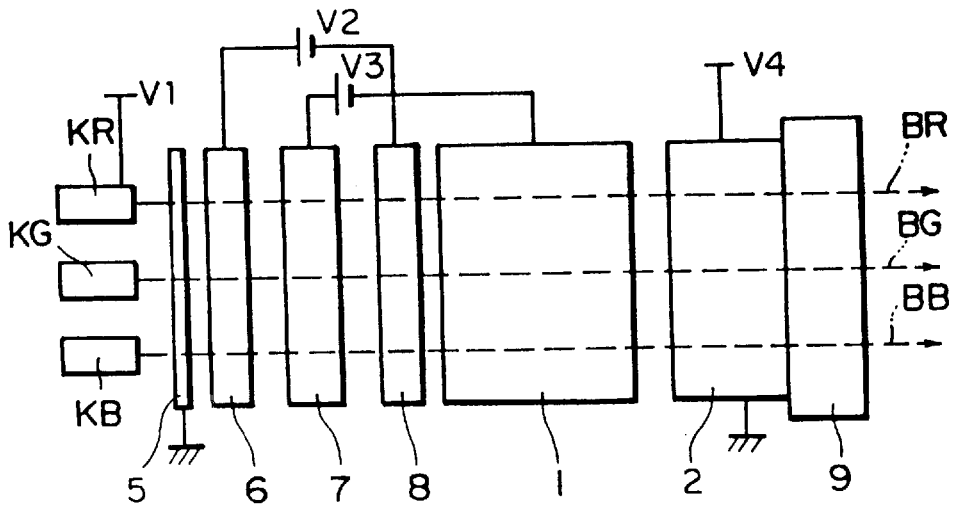
FIG. 1 is a view of the basic configuration of an in-line electron gun for a color cathode ray tube according to the present invention.

Below, a detailed explanation will be made of embodiments of the in-line electron gun for a color cathode ray tube according to the present invention while referring to the drawings.

First Embodiment

FIG. 1 is a view of the basic configuration of an in-line electron gun for a color cathode ray tube according to the present invention.

Figure 2:
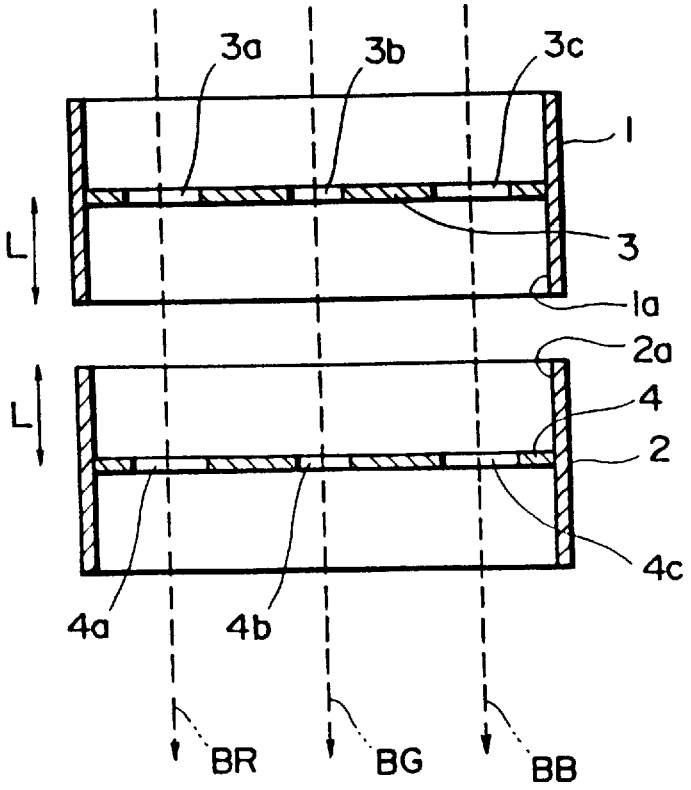
FIG. 2 is a view for explaining the configuration of an embodiment of a main lens portion of an in-line electron gun for a color cathode ray tube according to the present invention.

FIG. 2 is a view explaining the configuration of the main lens portion of the in-line electron gun for a color cathode ray tube according to a first embodiment of the present invention.

The in-line electron gun shown in FIG. 1 is basically constituted by electrodes arranged in-line and emitting electrons, i.e., a cathode electrode KR for RED, a cathode electrode KG for GREEN, a cathode electrode KB for BLUE, a first electrode 5, a second electrode 6, a third electrode 7, a fourth electrode 8, the focusing electrode 1 as the fifth electrode, the accelerating electrode 2 as the sixth electrode, and a shield cup 9. For example, a voltage V1 of 0 to 100 V is applied to the cathode electrodes KR, KG, and KB, the first electrode 5 is grounded, a voltage V2 of 200 to 800 V is applied to the second electrode 6 and the fourth electrode 8, a voltage V3 of 5 to 10 kV is applied to the third electrode 7 and the focusing electrode (fifth electrode) 1, and a voltage V4 of 20 to 30 kV is applied to the accelerating electrode (sixth electrode) 2.

The main lens portion shown in FIG. 2 is basically constituted by a focusing electrode 1 as a fifth electrode of the in-line electron gun shown in FIG. 1 and an accelerating electrode 2 as a sixth electrode. That is, the main lens portion shown in FIG. 2 is constituted by the focusing electrode 1 and the accelerating electrode 2 made of cylindrical metal members with opening portions 1*a* and 2*a* of elliptical cross-sections. Field-correcting electrode plates 3 and 4 are provided at predetermined positions inside the focusing electrode 1 and the accelerating electrode 2 in directions vertical relative to the directions of advance of the electron beams BR, BG, and BB.

Figure 3:
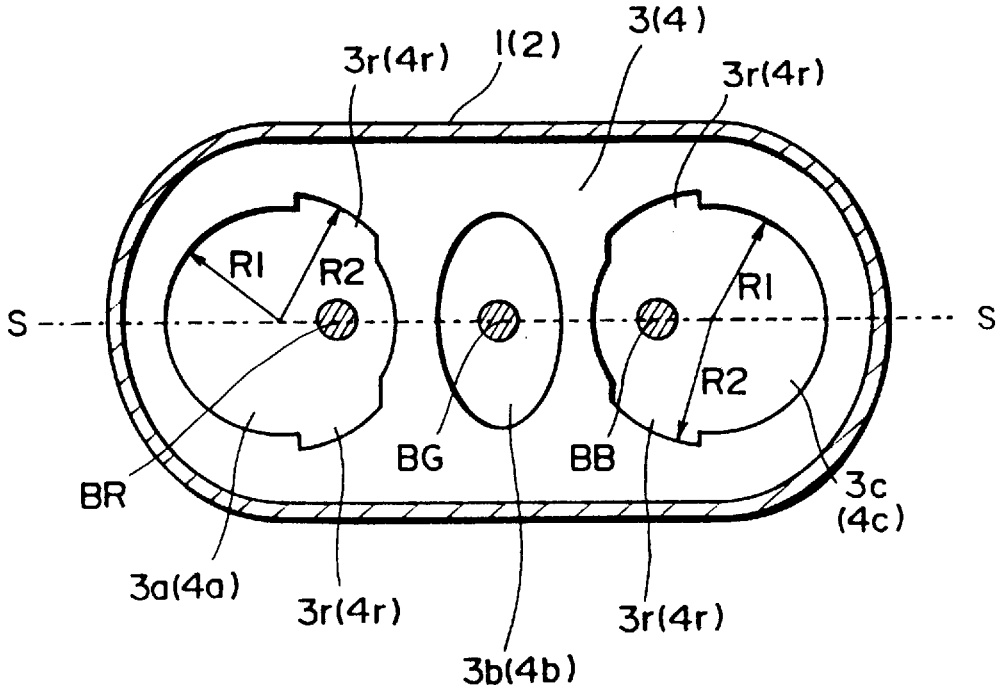
FIG. 3 is a sectional view of the main lens portion of FIG. 1 seen from the direction of progression of the electron beam.

FIG. 3 is a sectional view of the main lens portion shown in FIG. 2 seen from the directions of advance of the electron beams BR, BG, and BB. FIG. 3, in this illustration, shows the cross-section of one of the focusing electrode 1 or accelerating electrode 2.

As shown in FIG. 3, through apertures 3*a*, 3*b*, and 3*c* and 4*a*, 4*b*, and 4*c* through which three electron beams BR, BG, and BB respectively pass are formed in the elliptically shaped field-correcting electrode plates 3 and 4 at predetermined intervals in a long axis S direction of the ellipse. The through apertures 3*b* and 4*b* positioned at the center among the through apertures 3*a* to 3*c* and 4*a* to 4*c* are formed as elliptical apertures having a short axis on the long axis S of the elliptically shaped field-correcting electrode plates 3 and 4. On the other hand, the through apertures 3*a* and 3*c* and 4*a* and 4*c* on the two sides of the through apertures 3*b* and 4*b* located at the center are basically formed as circular apertures having a radius R1 but have cut-away portions 3*r* and 4*r* partially formed in a circumferential direction at the outside of the circular apertures continuous with the circular apertures.

These cut-away portions 3*r* and 4*r* are respectively formed at positions close to the center through apertures 3*b* and 4*b* symmetrically with respect to the long axis S of the field-correcting electrode plates 3 and 4 and are formed so the cut-away portions 3*r* and 4*r* straddle the paths of the electron beams BR and BB passing through the through apertures 3*a*, 3*c*, 4*a*, and 4*c*.

Further, the cut-away portions 3*r* and 4*r* are formed to arc shapes having the same centers as those of the circular apertures 3*a*, 3*c*, 4*a*, and 4*c* and having a radius R2 larger than the radius R1 of the circular apertures.

In the main lens portion constituted as described above, the focusing electrode 1 and the accelerating electrode 2 are formed for example by drawing a thin sheet, while the field-correcting electrode plates 3 and 4 are produced by for example punching. Since punching is more precise than drawing, the field-correcting electrode plates 3 and 4 can be raised in processing precision in comparison with the focusing electrode 1 and the accelerating electrode 2. Further, since the through apertures 3*a* and 3*c* and 4*a* and 4*c* are basically circular apertures and also the cut-away portions 3*r* and 4*r* are formed as arc shapes having the same centers as those of the through apertures 3*a*, 3*c*, 4*a*, and 4*c*, the processing precision can be made high. For this reason, if the field-correcting electrode plates 3 and 4 are positioned with a high precision at the time of assembly, the assembly precision can be raised in the in-line electron gun as a whole.

Figure 4:
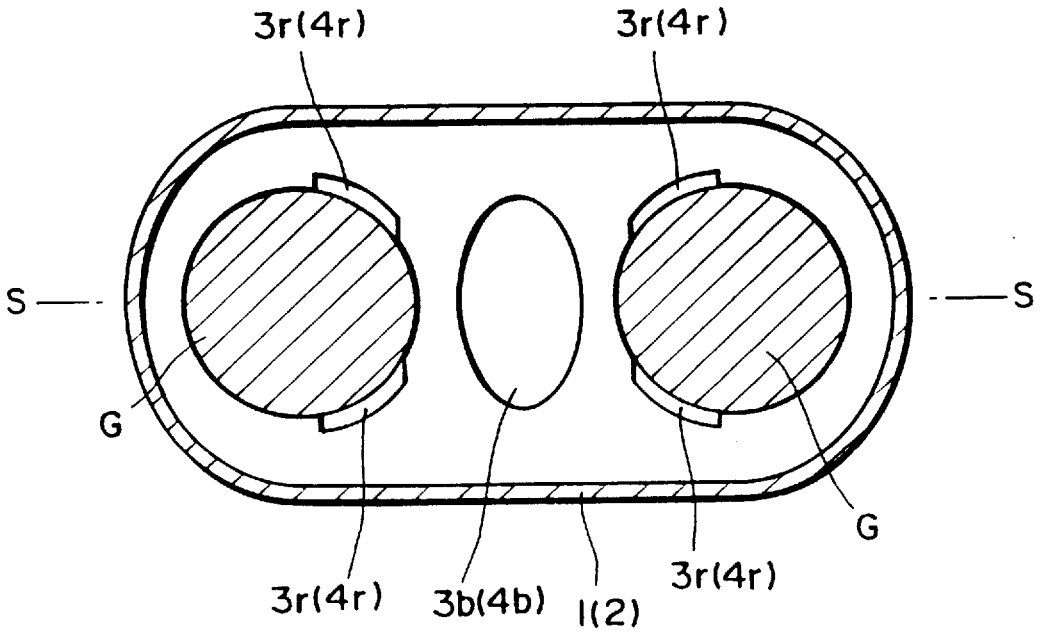
FIG. 4 is an explanatory view showing a state where circular inner core guides are inserted into the two side through apertures of a field-correcting electrode plate shown in FIG. 1.

In order to position the field-correcting electrode plates 3 and 4, for example, as shown in FIG. 4, two inner core guides G having circular cross-sections are fitted into the two side through apertures 3*a* and 3*c* and 4*a* and 4*c* to affix the field-correcting electrode plates 3 and 4. At this time, since the cut-away portions 3*r* and 4*r* are formed only partially at symmetrical positions with respect to the long axis S of the field-correcting electrode plates 3 and 4, the through apertures 3*a* and 3*c*, and 4*a* and 4*c* are basically circular apertures and the outer circumferential surfaces of the inner core guides G will fit in the circular aperture portions of the through apertures 3*a*, 3*c*, 4*a*, and 4*c* with a high precision.

Further, in this embodiment, since two inner core guides G are used, the positioning of the field-correcting electrode plates 3 and 4 in the rotation direction can also be performed with a high precision.

Next, an explanation will be made of the function of the cut-away portions 3*r* and 4*r* of the field-correcting electrode plates 3 and 4. Even if the electron beams are focused at the center of a screen, the electron beams will not be focused at the periphery of the screen due to the difference of curvature of the phosphor screen and the curvature of focusing of the electron beams. Further, usually, if there is astigmatism or other aberration in the main lens constituted by the focusing electrode 1 and the accelerating electrode 2, the spots of the electron beams will expand and the degree of sharpness of the image will be lost.

In this embodiment, the above aberration is positively corrected and adjusted by adjustment of the shape of the cut-away portions 3*r* and 4*r* formed in the through apertures 3*a*, 3*c*, 4*a*, and 4*c* of the field-correcting electrode plates 3 and 4.

Astigmatism is produced due to the asymmetry of the electric field of the main lens constituted by the focusing electrode 1 and the accelerating electrode 2, therefore the asymmetry of this electric field is corrected and adjusted by using the field-correcting electrode plates 3 and 4, but usually the shape of the through apertures of the field-correcting electrode plate is made elliptical or the like to newly form an asymmetrical electric field and this is combined with the electric field of the main lens to perform the correction and adjustment. However, as described above, if the through apertures of the field-correcting electrode plates are made elliptical in shape, circular inner core guides cannot be used at the time of assembly of the electron gun, therefore it is difficult to correctly position the field-correcting electrode plates.

Therefore, by providing the cut-away portions 3*r* and 4*r* in the through apertures 3*a*, 3*c*, 4*a*, and 4*c* of the field-correcting electrode plates 3 and 4, a similar function to that by making the through apertures elliptical in shape is exhibited. For example, if the radius R2 of the arcs of the cut-away portions 3*r* and 4*r* is made larger, the spots of the electron beams will become vertically longer near the center of the screen. When the spots of the electron beams become vertically longer, the spots of the electron beams change from laterally long to circular at the peripheral portion of the screen. Conversely, if the radius R2 of the arcs of the cut-away portions 3*r* and 4*r* is made smaller, the electron beams will approach a circular shape near the center of the screen, while the spots will become laterally longer at the peripheral portion of the screen.

Accordingly, by appropriately adjusting the radius R2 of the arcs of the cut-away portions 3*r* and 4*r* at the time of design of the main lens portion in the electron gun, it is possible to give priority to the resolution of the screen of the color cathode ray tube near the center of the screen, give priority to the resolution at the peripheral portion of the screen, or give priority to the resolution of the entire screen.

When correcting and adjusting the electric field, the size of the radius R2 of the arcs of the cut-away portions 3*r* and 4*r* of the field-correcting electrode plates 3 and 4 is determined from the distance L etc. of the field-correcting electrode plates 3 and 4 from the facing end surfaces inside the focusing electrode 1 and the accelerating electrode 2 shown in FIG. 2. Namely, the optimum radius R2 must be determined by the distance L etc. of the field-correcting electrode plates 3 and 4 from the facing end surfaces.

Next, consider the relationship between the radius R1 of the through apertures and the radius R2 of the arcs of the cut-away portions. In this embodiment, the radius R2 is determined so that the ratio R2/R1 of the radius R1 of the through apertures 3*a*, 3*c*, 4*a*, and 4*c* and the radius R2 of the arcs of the cut-away portions 3*r* and 4*r* becomes within the range of 1.0 to 1.3. The grounds for this will be explained next. The reason why the ratio R2/R1 of the radius R1 and the radius R2 was made larger than 1.0 is that the radius R2 must be larger than the radius R1 when forming the cut-away portions 3*r* and 4*r*. The reason why the ratio was made smaller than 1.3 is that the focusing of the spot of the electron beam will no longer be adjustable in focus if larger than this—regardless of the distance L etc. of the field-correcting electrode plates 3 and 4 from the facing end surfaces inside the focusing electrode 1 and the accelerating electrode 2. Accordingly, if the size of the radius R2 is adjusted within the range where the ratio R2/R1 of the radius R1 and the radius R2 is from 1.0 to 1.3, as described above, it is possible to give priority to the resolution of the screen of the color cathode ray tube near the center of the screen, give priority to the resolution at the peripheral portion of the screen, or give priority to the resolution of the entire screen.

Examples of actual values of the radius R1 and the radius R2 will be mentioned next. For example, the radius R1 of the circular apertures 3*a*, 3*c*, 4*a*, and 4*b* can be formed to 3.2 mm, and the radius R2 of the arc of the cut-away portions 3*r* and 4*r* can be formed to 3.25 mm.

Note that, it is also possible to adjust the radius R2 of the two cut-away portions 3*r* and 4*r* formed at symmetrical positions to have values different from each other according to the conditions of the in-line electron gun to be set and it is also possible to adjust the same by making the radii R2 in the cut-away portions 3*r* and 4*r* different from each other.

As described above, according to the in-line electron gun for a color cathode ray tube according to the present embodiment, the through apertures 3*a*, 3*c*, 4*a*, and 4*c* among the three through apertures of each of the field-correcting electrode plates 3 and 4 are basically circular apertures, so the relative positioning of the field-correcting electrode plates 3 and 4 can be carried out with a high precision by using circular inner core guides, therefore the precision of assembly of the in-line electron gun for a color cathode ray tube can be improved.

Further, in this embodiment, the two side through apertures 3*a*, 3*c*, 4*a*, and 4*c* among the three through apertures of each of the field-correcting electrode plates are basically made circular apertures formed with the cut-away portions 3*r* and 4*r* at the outsides of the circular apertures. These cut-away portions 3*r* and 4*r* form arc shapes with the same centers as the circular apertures. Therefore, precise processing of the field-correcting electrode plates 3 and 4 is possible, and particularly the management of precision of the through apertures 3*a*, 3*c*, 4*a*, and 4*c* becomes easy.

Further, in this embodiment, by the adjustment of the shape of the cut-away portions 3*r* and 4*r* formed in the through apertures 3*a*, 3*c*, 4*a*, and 4*c* of the field-correcting electrode plates 3 and 4, astigmatism or other aberration can be corrected and adjusted in the main lens of the in-line electron gun. Therefore, the astigmatism and other aberration of the main lens can be freely adjusted. Further, the degree of freedom of design of the main lens comprised of the focusing electrode and adjoining accelerating electrode becomes greater.

Further, according to this embodiment, as explained above, it is possible to adjust the astigmatism or other aberration of the main lens and, at the same time, it becomes possible to perform the positioning by inserting circular section inner core guides into the two side through apertures, so even in electron guns having different specifications or tube types, it is possible to use the same guides for the positioning and assembly and therefore make common use of the facilities.

Further, according to this embodiment, by adjusting the size of the radius R2 of the arcs of the out-away portions to a range where the ratio R2/R1 of the radius R1 of the circular apertures constituting the through apertures and the radius R2 of the arcs of the cut-away portions becomes 1.0 to 1.3, it is possible to give priority to the resolution of the screen of the color cathode ray tube near the center of the screen, give priority to the resolution at the peripheral portion of the screen, or give priority to the resolution of the entire screen.

Second Embodiment

Figure 5A:
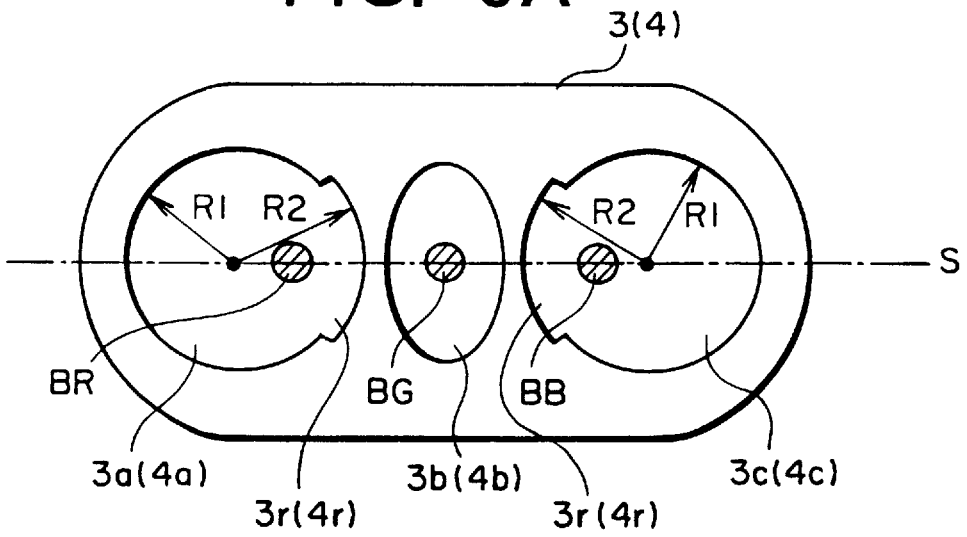
Figure 5B:
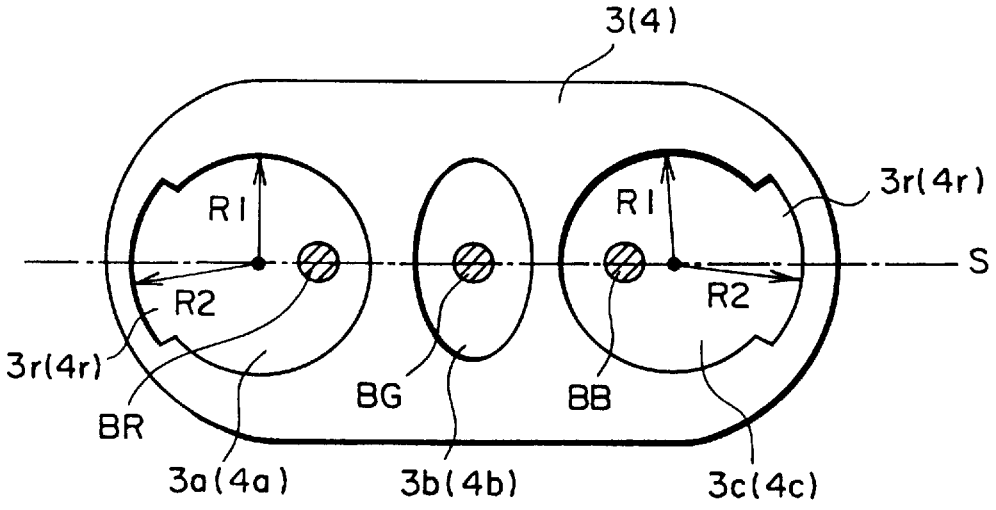

Next, an explanation will be made of examples of shapes in a second embodiment of the field-correcting electrode plates in the in-line electron gun for a color cathode ray tube according to the present invention referring to FIG. 5A and FIG. 5B. FIG. 5A shows a case where the cut-away portions 3*r* (4*r*)are formed close to the center through aperture 3*b* and crossing the long axis S of the field-correcting electrode plate 3 (4), while FIG. 5B shows a case where the cut-away portions 3*r* (4*r*)are formed away from the center through aperture 3*b* and crossing the long axis S of the field-correcting electrode plate. Note that in the field-correcting electrode plates 3 and 4 shown in FIGS. 5A and SB, the cut-away portions 3*r* and 4*r* are formed at only one part of each of the through apertures 3*a*, 3*c*, 4*a*, and 4*c*.

In the first embodiment, the through apertures 3*a*, 3*c*, 4*a*, and 4*c* were basically circular apertures with the cut-away portions 3*r* and 4*r* formed continuous with the outsides of the circular apertures at two positions so as to straddle the paths of the electron beams BB and BR. This enabled the correction of the electric field in the vertical axis direction with respect to the electron beams, therefore was suited to adjustment of the spots of the electron beams BB and BR irradiated to the phosphor screen in the vertical long direction.

On the other hand, in the field-correcting electrode plates 3 and 4 shown in FIGS. 5A and 5B, the cut-away portions are formed at only one position and formed so as to cross the long axis S of the field-correcting electrode plates 3 and 4. Therefore, the electric field in the lateral axis direction with respect to the electron beams BB and BR is corrected, so this is suited to adjustment of the spots of the electron beams BB and BR to the lateral long direction.

In other respects, the second embodiment exhibits similar effects to those of the first embodiment explained above.

Note that the cut-away portions 3*r* and 4*r* have mutually opposite positional relationships in the field-correcting electrode plates 3 and 4 of FIG. 5A and the field-correcting electrode plates 3 and 4 of FIG. 5B, therefore the directions of adjustment of the spots of the electron beams become reverse.

Other Embodiments

In the above embodiments, a number of examples were shown for the positions for forming the cut-away portions 3*r* and 4*r*, but the present invention is not limited to them. They can be formed at positions in accordance with the production conditions of the in-line electron gun for a color cathode ray tube. Further, the shape of the cut-away portions 3*r* and 4*r* is not limited to an arc shape. Various other shapes can be adopted as well in accordance with the shapes of the field-correcting electrode plates and the electron beams.

According to the in-line electron gun for a color cathode ray tube of the present invention, it becomes possible to perform the positioning by inserting circular inner core guides into the two side through apertures at the time of assembly of the electron gun, so it becomes possible to easily improve the assembly precision of the electron gun.

Further, according to the present invention, it becomes possible to freely adjust the astigmatism or other aberration of the main lens comprised of the focusing electrode and the adjoining accelerating electrode by the shape of the cut-away portions. As a result, it is possible to give priority to the resolution of the screen of the color cathode ray tube near the center of the screen, give priority to the resolution at the peripheral portion of the screen, or give priority to the resolution of the entire screen.

Further, according to the present invention, it becomes easy to process the field-correcting electrode plate with a high precision.

Still further, according to the present invention, since it is possible to adjust the astigmatism or other aberration and, at the same time, becomes possible to perform the positioning by inserting circular inner core guides into the two side through apertures, even in electron guns having different specifications or tube types, it is possible to use the same guides for the positioning and assembly and therefore make common use of the facilities.

Further, according to the present invention, by adjusting the size of the radius R2 of the arcs of the cut-away portions to a range where the ratio R2/R1 of the radius R1 of the circular apertures constituting the through apertures and the radius R2 of the arcs of the cut-away portions becomes 1.0 to 1.3, it is possible to give priority to the resolution of the screen of the color cathode ray tube near the center of the screen, give priority to the resolution at the peripheral portion of the screen, or give priority to the resolution of the entire screen.

What is claimed is:

1. An in-line electron gun for a color cathode ray tube having a main lens, said main lens including at least one field-correcting electrode plate having three through apertures through which electron beams may pass arranged in-line along a predetermined axial direction, each of two side through apertures among the three through apertures being formed by a circular aperture and at least one predetermined shape cut-away portion which is formed at the outside of the circular aperture and continues to the circular aperture, wherein the center through aperture among the three through apertures formed in the field-correcting electrode plate is an elliptical aperture.

2. An in-line electron gun for a color cathode ray tube as set forth in claim 1, wherein the cut-away portion is formed to an arc shape having the same center as that of the circular aperture.

3. An in-line electron gun for a color cathode ray tube as set forth in claim 1, wherein the center through aperture among the three through apertures formed in the field-correcting electrode plate is an elliptical aperture having a short axis on a predetermined axis.

4. An in-line electron gun for a color cathode ray tube as set forth in claim 1, wherein there are a plurality of said field-correcting electrode plates.

5. An in-line electron gun for a color cathode ray tube as set forth in claim 2, wherein the ratio R2/R1 of a radius R1 of the circular aperture and a radius R2 of the arc of the cut-away portion is 1.0 to 1.3.

6. An in-line electron gun for a color cathode ray tube as set forth in claim 2, wherein each of the two side through apertures among the three through apertures has only one cut-away portion the cut-away portions being formed close to the center through aperture among the three through apertures and crossing a predetermined axis such that the cut-away portions are facing each other.

7. An in-line electron gun for a color cathode ray tube as set forth in claim 2, wherein each of the two side through apertures among the three through apertures has only one cut-away portion, the cut-away portions being formed away from the center through aperture among the three through apertures and crossing a predetermined axis such that the cut-away portions are facing away from other.

8. An in-line electron gun for a color cathode ray tube as set forth in claim 2, wherein each of the two side through apertures among the three through apertures has a plurality of cut-away portions, the cut-away portions formed in the through apertures being formed at symmetrical positions with respect to a predetermined axis.

9. An in-line electron gun for a color cathode ray tube as set forth in claim 8, wherein the plurality of cut-away portions on each of the two side through apertures among the three through apertures forms an angle less than 180 degrees.

10. An in-line electron gun for a color cathode ray tube as set forth in claim 3, wherein two cut-away portions are formed so the two cut-away portions straddle the paths of electron beams passing through the through apertures.

11. An in-line electron gun for a color cathode ray tube having a main lens, said main lens including at least one field-correcting electrode plate having three through apertures through which electron beams may pass arranged in-line along a predetermined axial direction, each of two side through apertures among the three through apertures being formed by a circular aperture and a predetermined shape cut-away portion which is formed at the outside of the circular aperture and continues to the circular aperture.

12. An in-line electron gun for a color cathode ray tube as set forth in claim 11, wherein the cut-away portions of the two side through apertures are formed close to the center through aperture and crossing a predetermined axis such that the cut-away portions are facing each other.

13. An in-line electron gun for a color cathode ray tube as set forth in claim 11, wherein the cut-away portions of the two side through apertures are formed away from the center through aperture and crossing a predetermined axis such that the cut-away portions are facing away from other.

14. An in-line electron gun for a color cathode ray tube as set forth in claim 11, wherein there are a plurality of said field-correcting electrode plates.

15. An in-line electron gun for a color cathode ray tube having a main lens, said main lens including a field-correcting electrode plate having three through apertures through which electron beams may pass arranged in-line along a predetermined axial direction and forming a main lens, each of two side through apertures among the three through apertures being formed by a circular aperture and a plurality of predetermined shape cut-away portions which is formed at the outside of the circular aperture and continues to the circular aperture, the plurality of cut-away portions being formed at symmetrical positions with respect to a predetermined axis and forming an angle less than 180 degrees.

16. An in-line electron gun for a color cathode ray tube as set forth in claim 15, wherein there are a plurality of said field-correcting electrode plates.

17. An in-line electron gun for a color cathode ray tube having a main lens, said main lens including a plurality of field-correcting electrode plates, each of said plurality of field-correcting electrode plates having three through apertures through which electron beams may pass arranged in-line along a predetermined axial direction and forming a main lens, wherein each of two side through apertures among the three through apertures being formed by a circular aperture and at least one predetermined shape cut-away portion which is formed at the outside of the circular aperture and continues to the circular aperture.

* * * * *